US007762744B2

(12) United States Patent
Natvig

(10) Patent No.: US 7,762,744 B2
(45) Date of Patent: Jul. 27, 2010

(54) METHOD AND VESSEL FOR REMOVING OFFSHORE STRUCTURES

(75) Inventor: Birger J. Natvig, Haslum (NO)

(73) Assignee: Delta Lifter Technologies AS, Nesbru (NO)

( * ) Notice: Subject to any disclaimer, the term of this patent is extended or adjusted under 35 U.S.C. 154(b) by 0 days.

(21) Appl. No.: 10/576,283

(22) PCT Filed: Oct. 27, 2004

(86) PCT No.: PCT/NO2004/000327

§ 371 (c)(1),
(2), (4) Date: Dec. 11, 2006

(87) PCT Pub. No.: WO2005/039968

PCT Pub. Date: May 6, 2005

(65) Prior Publication Data

US 2007/0140794 A1 Jun. 21, 2007

(30) Foreign Application Priority Data

Oct. 28, 2003 (NO) ..... 20034814

(51) Int. Cl.
*E02D 25/00* (2006.01)
*E02D 23/02* (2006.01)

(52) U.S. Cl. ..... 405/209; 405/206; 114/49

(58) Field of Classification Search ..... 405/203–206, 405/209; 114/49, 258, 259, 260
See application file for complete search history.

(56) References Cited

U.S. PATENT DOCUMENTS 3,347,052 A 10/1967 Steitle et al.
3,448,712 A * 6/1969 Adams et al. ..... 114/259
3,823,564 A * 7/1974 Crout et al. ..... 405/209
3,859,804 A 1/1975 Koehler et al.
5,111,764 A * 5/1992 D'Ettorre ..... 114/259
6,276,875 B1 * 8/2001 Gunnar et al. ..... 405/203
6,540,441 B1 * 4/2003 Foss et al. ..... 405/203
2004/0258483 A1 * 12/2004 Vatsvag ..... 405/203

FOREIGN PATENT DOCUMENTS

WO WO03/033342 4/2003

OTHER PUBLICATIONS

Norwegian Search Report for Patent No. 20034814 dated May 14, 2004.
International Search Report for International Application No. PCT/NO2004/000327 dated Feb. 22, 2005.

* cited by examiner

*Primary Examiner*—Tara Mayo-Pinnock
(74) *Attorney, Agent, or Firm*—Kolisch Hartwell, PC

(57) ABSTRACT

A method and vessel for removing or installing an offshore jacket structure in a body of water, the vessel having a generally planar main buoyancy section having the outline of a delta with an extension at the apex and auxiliary buoyancy sections extending transversely of the main buoyancy section at the ends of the base of the delta. The bottom parts of the auxiliary buoyancy sections have a rounded outer surface and contain heavy fixed ballast. The vessel may be rotated as it is brought close to the jacket structure with the auxiliary sections straddling the jacket structure. The vessel is rotated towards the jacket structure while its rounded bottom portion rolls on the seabed. Once the jacket structure is connected securely to the vessel, the vessel is rotated back to the initial position de-ballasting the auxiliary sections before it is brought to the surface.

5 Claims, 5 Drawing Sheets

METHOD AND VESSEL FOR REMOVING OFFSHORE STRUCTURES

FIELD OF INVENTION

The present invention relates to a method for removing an offshore jacket structure standing on the sea bed in a body of water in accordance with the preamble of claim 1. The invention also relates to a seagoing vessel for removing or installing and transporting an offshore jacket structure as recited in the preamble of claim 5.

BACKGROUND OF THE INVENTION

U.S. Pat. No. 6,540,441 describes a transporter for removing offshore jacket structures, said transporter having an elongate cradle-like structure made from tubular elements. The cradle-like structure has a U-shaped cross section. When approaching a jacket structure to be removed, the transporter is rotated 90° and floated in vertical orientation so as to embrace the jacket on three sides. After the transporter has been attached to the jacket and the legs of the jacked severed, the transporter with the jacket is raised through de-ballasting and rotated back to the horizontal position before being towed to a predetermined destination for the jacket. Even though the transporter in its vertical position is moved towards the jacket both by means of tugs and winches, it has a quite substantial water line area which makes it prone to uncontrolled movements caused by environmental forces like waves, such movements being particularly critical in the connecting phase since the jacked could easily be damaged. The transporter according to U.S. Pat. No. 6,540,441 also has the drawback of being larger than necessary in the sense that it has about twice as much buoyancy as necessary for carrying the jacket structure. This is because the sides of the U-shaped cradle will be entirely above the water in a towing situation.

The purpose of the present invention is to alleviate the drawbacks mentioned above and to provide a method and vessel that will permit the vessel to approach the jacket structure in a safe and controlled manner also under inclement weather conditions, while the shape of the vessel is such that it has little excess buoyancy and is easy to build with common shipyard technology and equipment.

This is obtained according to the invention by a method as recited in claim 1 and a vessel as recited in claim 5. Advantageous embodiments of the inventions are recited in the respective dependent claims.

For better understanding of the invention it is referred to the following description of the exemplifying embodiment shown in the appended drawings.

DETAILED DESCRIPTION OF THE INVENTION

Figure 1:
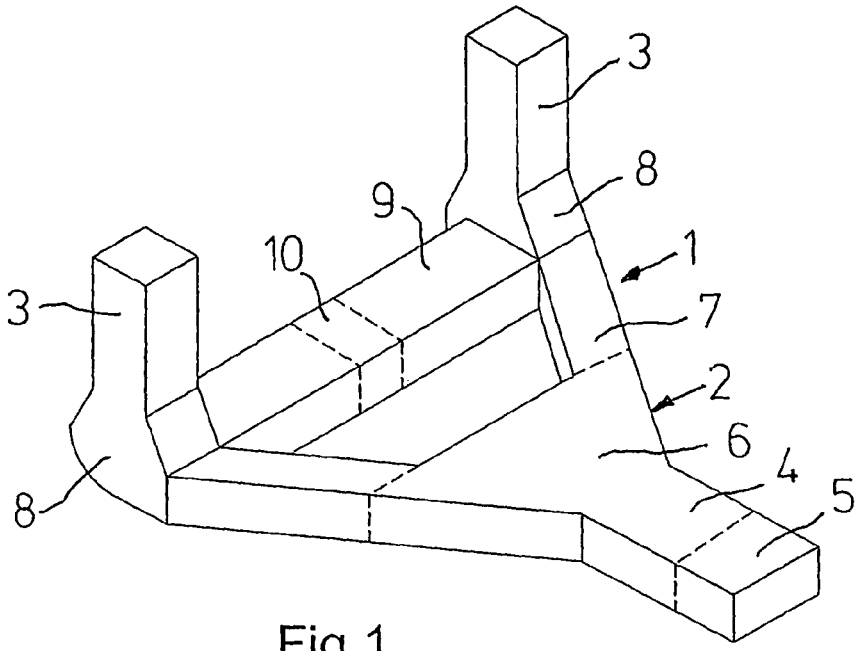
FIG. 1 shows a schematic, isometric view of a vessel according to the invention.

The vessel 1 shown in FIG. 1 comprises a generally planar, ballastable main buoyancy section 2 and two auxiliary buoyancy sections 3 protruding from the main section. At the fore end, the main buoyancy section 2 has a rectangular box section 4, also labelled the nose section, where the forward part 5 will serve as reserve buoyancy during submerging operations and will thus always be above the still water level. This forward part may contain a control and power room served by an umbilical cable (not shown) running from a standby and support vessel (not shown). Connected to the nose section 4 is a trapeze-shaped transition section 6, from which two diverging branch pontoon sections 7 extend and are joined to footing sections 8 for the auxiliary buoyancy sections or columns 3. The footing sections 8 are joined by a transverse buoyancy section 9 bridging the gap between the distal ends of the diverging branch sections 7. The transverse section 9 contains a pump room 10.

Generally speaking, in plan view the vessel is delta-shaped with a nose section added at the apex, or it may also be likened to a Y, except for the transverse section 9.

With the exception of the control room 5 and pump room 9, the complete vessel 1 is subdivided into ballast compartments. This is indicated in the side view in FIG. 2, which also shows that the footing sections 8 has a rounded bottom portion 11 which contains a heavy permanent or semi-permanent ballast 12.

Figure 2:
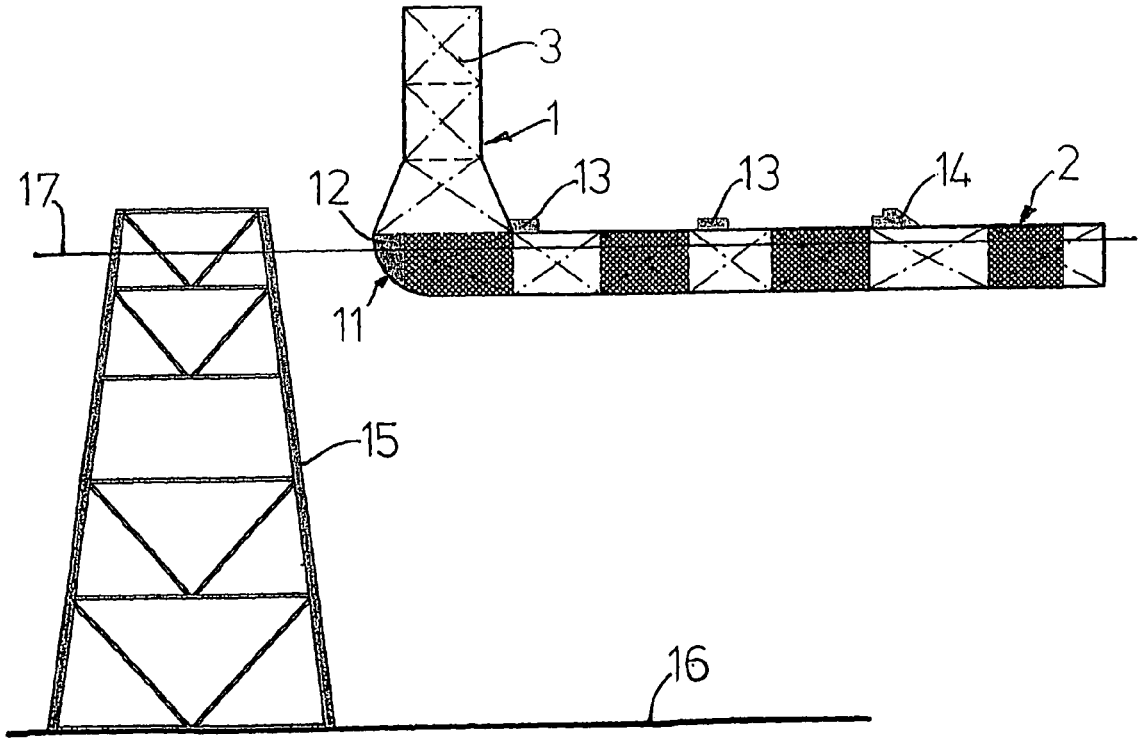
FIGS. 2-10 show side views of various stages of a method according to the invention for removing a jacket structure.

The vessel 1 is preferably made as a stiffened flat plate construction all-over. Although such a construction is heavier than a tubular construction for the same buoyancy, the flat plate construction has several advantages. For instance, flat plate constructions can be efficiently manufactured in shipyards due to their long established highly mechanised production lines for such structures. The steel material will not be a major cost factor in this connection. The heavier plating required at the deep submergence end of the vessel will contribute to the fixed ballast needed at this end for reasons of hydrostatic stability during the submergence operation, as will be explained later. The flat plate construction further provides flat deck surfaces that will simplify and reduce the cost of providing jacket support points due to the freedom to choose the position of such points. FIG. 2 shows preinstalled jacket support stools 13 and heavy brackets 14 for connection to the jacket structure 15.

Although the size of the vessel 1 will depend on the size of the jacket structures 15 to be removed or installed, a preferred embodiment for service in the North Sea has an overall length of 115 meter, a maximum width of 100 meter and auxiliary columns 37 meter high. The steel weight is about 6200 tons and the fixed ballast 5000 ton. The displacement is about 30 000 ton for the main buoyancy section and about 11 000 ton for the auxiliary buoyancy columns. The maximum steel plate thickness is about 40 mm.

Such a vessel would be able to handle jacket structures weighing about 8000 ton.

The method according to the invention will be described below with reference to FIGS. 2-10. In FIG. 2, the vessel 1 according to the invention is shown in semi-ballasted condition near a jacket structure 15 to be removed. The shaded areas of the vessel indicate ballasted compartments. The vessel is brought in this position by means of tugs (not shown). No anchoring or any other form of traditional mooring system need be used during the manoeuvring of the vessel towards the jacket, thus avoiding amplified second order horizontal motion of the vessel.

Figure 3:
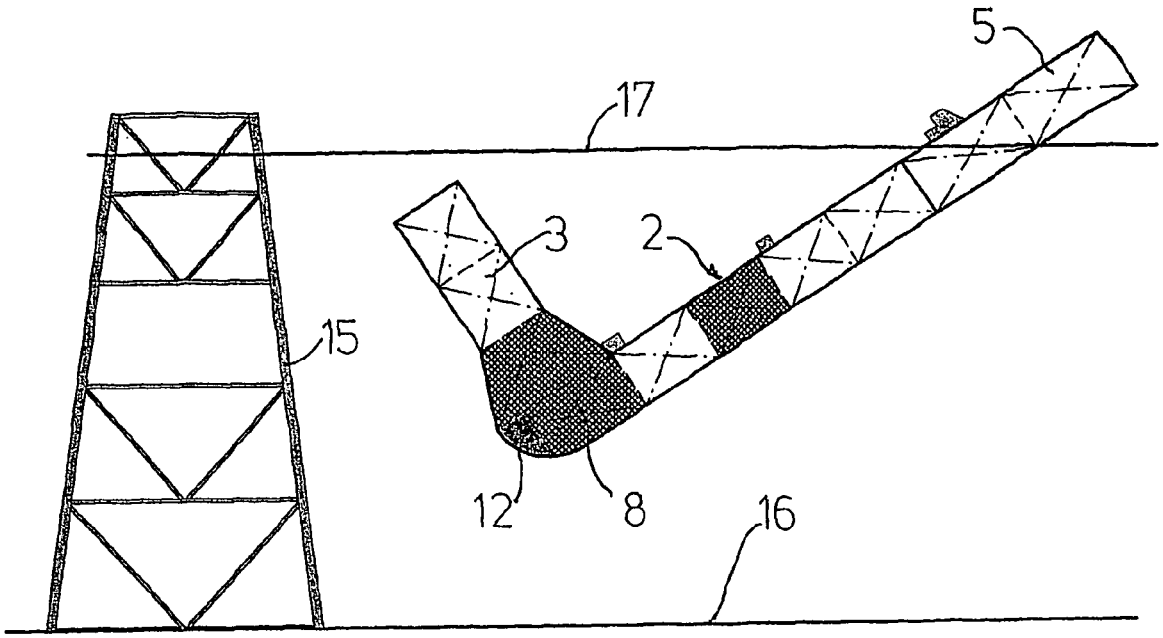

In FIG. 3 ballast has been shifted from the fore part to the footing sections 8 to make the vessel rotate an angle less than 90° from the horizontal. The vessel may be in equilibrium in the position shown due i.a. to the fixed ballast 11. Other equilibrium positions may be obtained through proper ballast adjustments.

Figure 4:
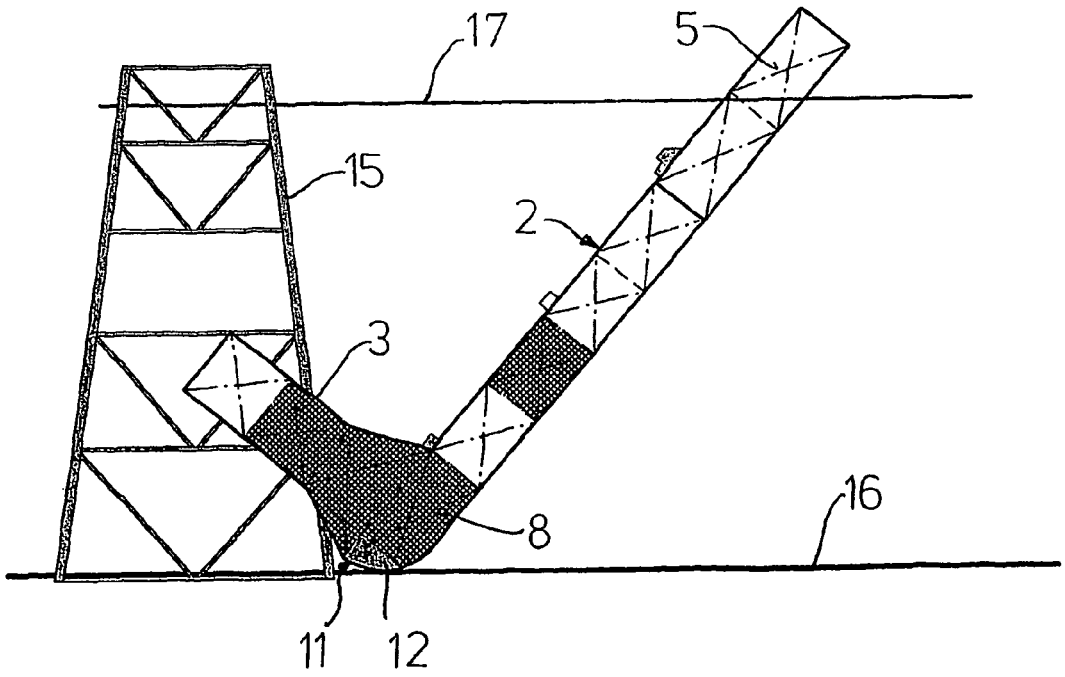

In FIG. 4 the vessel 1 has been moved closer to the jacket 15 so that the auxiliary buoyancy columns 3 straddle the jacket. More ballast has been added to the columns 3 in order to bring the rounded bottom portion 11 of the footings 8 to rest on the seabed 16 close to the jacket 15. While in this position, further ballast is added to build up sufficient bottom contact pressure to prevent the vessel 1 from lifting from the sea bed during design wave conditions.

During the procedure of bringing the vessel 1 to the position shown in FIG. 4, the only duty of the tugs is to counteract the mean environmental loads, e.g. wind, waves and current. From recordings of wave, wind and current sensors these loads are estimated and are apportioned to each tug. From constant tension winches (not shown) on top of the nose section 5 of the vessel, lines are run through pulleys on the lower part of the vessel to the jacket where they are connected. From measurements of the mean loads in these lines, corrections of the tug trust loads will be apportioned to improve the ability of the tugs to counteract the mean environmental loads. The reason for this load sharing strategy is to relieve the connecting lines from carrying environmental loads so that the line strength can be used to apply manoeuvring loads only.

Figure 5:
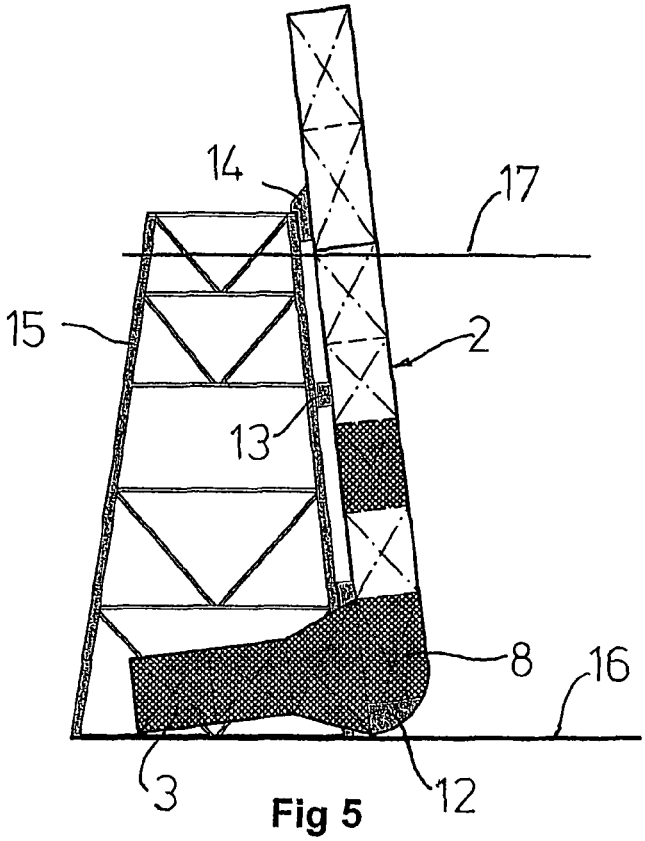

In FIG. 5 further ballast has been added to the auxiliary columns 3 in order to rotate the vessel beyond 90° so that the main section 2 is in contact with the jacket 15 by means of its support stools 13 and connecting brackets 14.

This removal operation assumes that the legs of the jacket structure have been cut in advance. It may be necessary to fix e.g. a sleeve arrangement around some of the legs in order to prevent the cut ends from slipping off their contact surfaces when bringing the vessel 1 into contact with the jacket. However, the slender shape of the fore part of the vessel makes it relatively wave transparent, thus minimizing the wave induced forces transferred from the vessel to the jacket.

Before lifting of the jacket can start, the brackets 14 will have to be securely connected to legs of the jacket. These connections can be of a direct welded type, a gripper type, a wedge type, or any suitable type known to the skilled person. The purpose of these connection brackets is to carry the complete weight of the jacket as it is lifted from the seabed.

Figure 6:
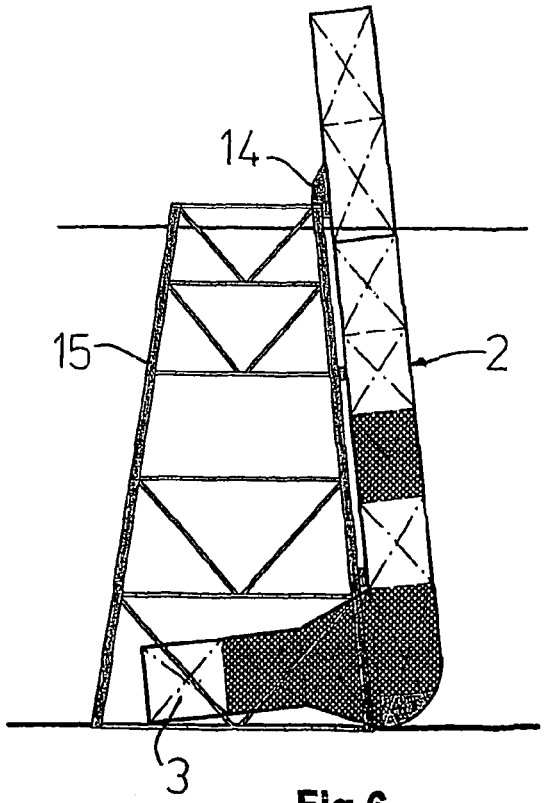
Figure 7:
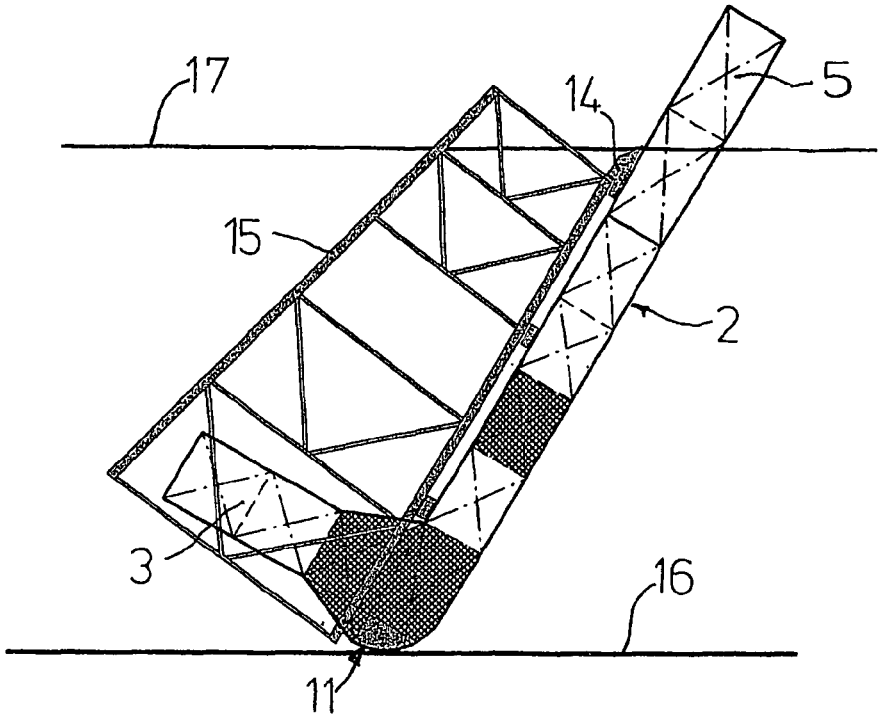

When the preparations for lifting the jacket are completed, ballast water is pumped out of the vessel 1. This may be done in a way to make it first move mainly vertically from the seabed before starting the rotation movement. In some applications, however, it may be preferable to start the removal of the ballast water in such a way that the vessel 1 and jacket 15 are rotated while the bottom rounded part 11 of the vessel is still in contact with the seabed 16. This sequence is illustrated in FIGS. 6 and 7. This will transfer some of the weight of the jacket 15 to the support stools 13 of the vessel 1, thus taking some of the stress off the connecting brackets 12. As a result, the initial lifting of the jacket can be performed in a controlled manner with less risk of the jacket breaking loose from the vessel due to unexpected environmental influence or other unforeseen circumstances. It will be understood that the rotating movement from the FIG. 6 to the FIG. 7 position, wherein the main section 2 of the vessel may have assumed an angle of about 60° with the water surface 17, is obtained by removing ballast from the auxiliary columns 3.

Figure 8:
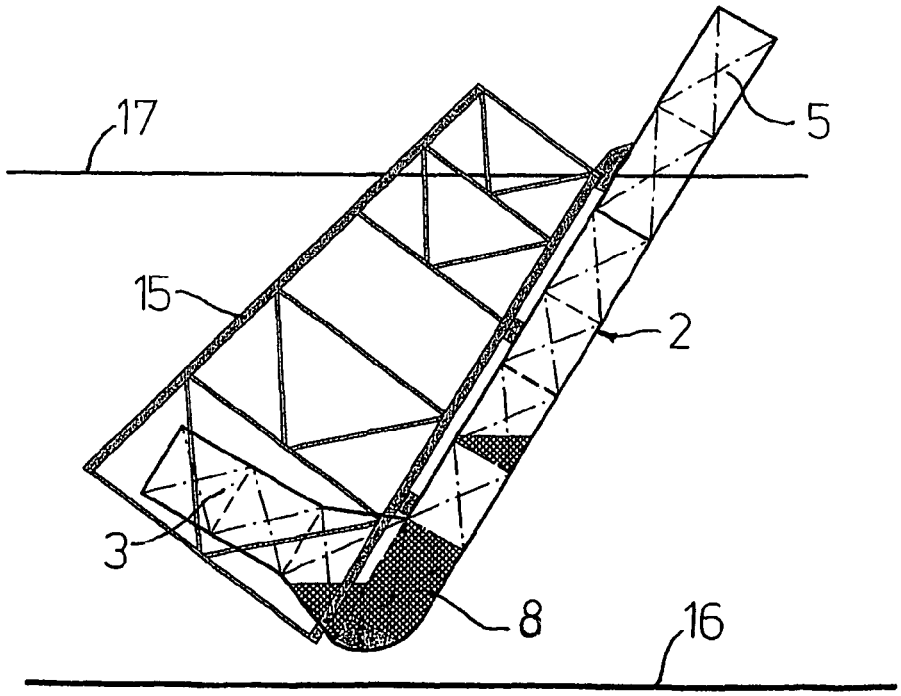
Figure 9:
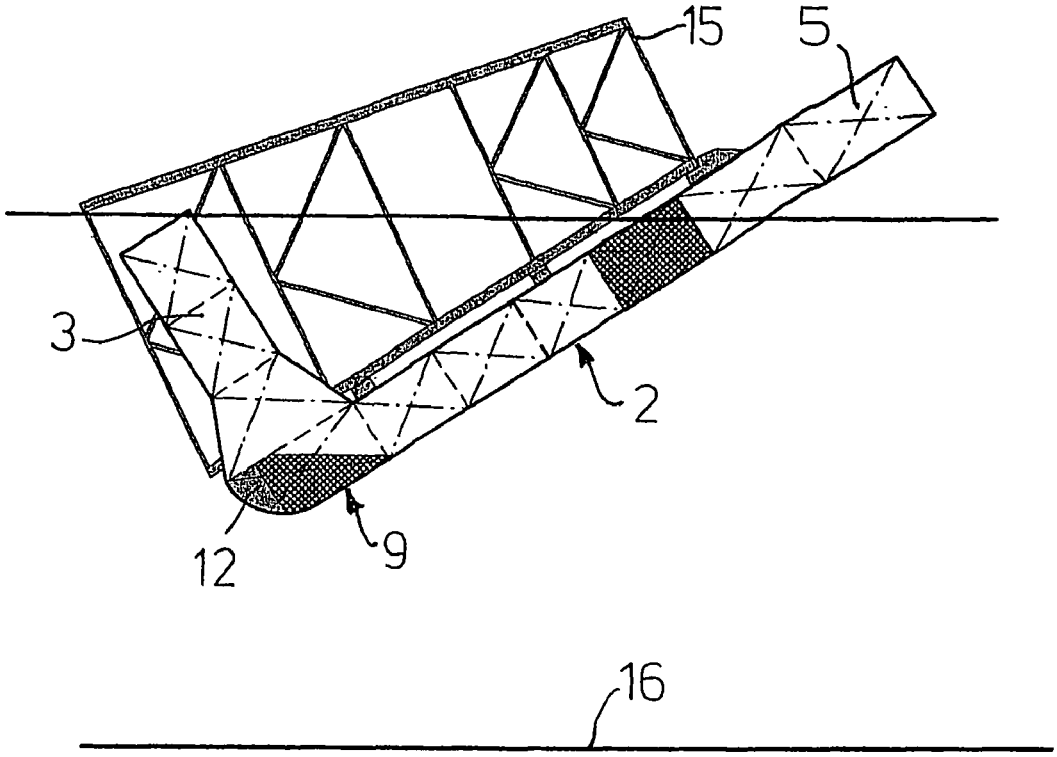
Figure 10:
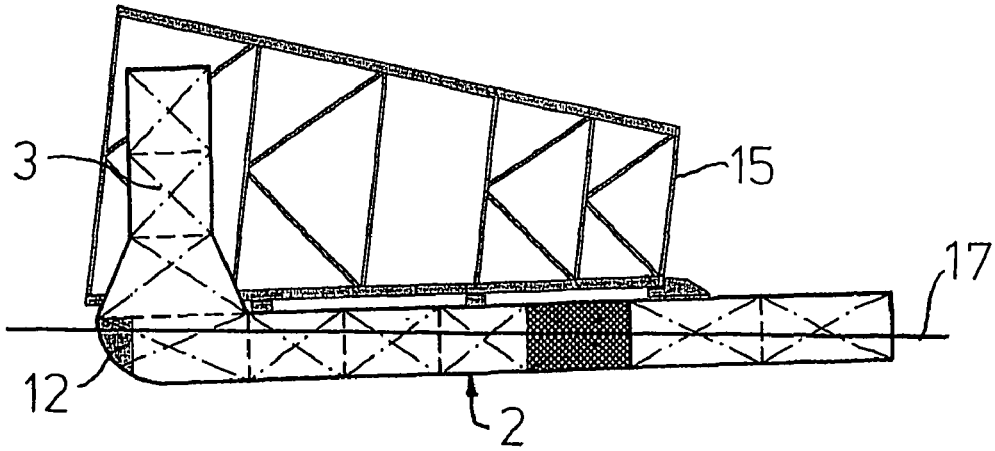

When in the FIG. 7 situation, further ballast is removed in order to lift the vessel and jacket from the seabed, as indicated in FIG. 8. Further de-ballasting, primarily of the transverse pontoon section 9, will bring the vessel and jacket through the position illustrated in FIG. 9 to the final position in FIG. 10. After securing the jacket 15 to the vessel 1, the vessel may be towed to the final destination of the jacket.

It will be noted that during the entire procedure described above, a part of the nose section 5 is always above the water for stability reasons.

It will be understood that the vessel according to the invention also may be used for installing a jacket structure. In this case, the method according to the invention will be performed essentially in the reverse order, except that no winches are necessary on the vessel.

The heavy permanent or semi-permanent ballast 12 in the vessel 1 may consist of concrete, iron or mud, brine or the like. In this context, semi-permanent means that the ballast may be removed, but not by simple pumps. Furthermore, the heavy ballast may at least partly be provided through the use of heavier plating than otherwise necessary in the area of the footings 8 of the columns 3. Although these columns in the exemplifying embodiment described above are shown having a quadrangular cross section, if expedient, they may have an oval or circular cross section, or consist of a cluster of tubular members, e.g. taken from legs of an already scrapped jacket structure.

In the embodiment described above the water depth permits the vessel to be set down on the seabed before attachment to the jacket. However, it is also possible to use the vessel according to the invention in somewhat deeper water where the vessel would not be able to touch the seabed without becoming totally immersed. In such cases, the vessel will still approach the jacket at an angle, but this will occur at some distance above the seabed. The draft of the vessel will be determined by the amount of overhang permitted by the available capacity in the vessel to shift the centre of buoyancy to compensate for the offset centre of gravity.

Although the invention has been described above with reference to a specific exemplifying embodiment, it will be clear to the skilled person that the invention may be varied and modified within the frame of the invention defined by the elements of the appended claims and their equivalents.

The invention claimed is:

1. A method for removing an offshore jacket structure (15) standing on the seabed (16) in a body of water, said method comprising the steps of:

(a) providing a ballastable seagoing vessel (1) having a generally float-like main buoyancy section (2) being generally planar and being generally horizontal in the normal floating condition of the vessel (1) and having two elongate auxiliary buoyancy sections (3) protruding above and on either side of the main buoyancy section (2) in said normal floating condition;

(b) bringing said vessel (1) into the vicinity of the jacket structure (15);

(c) ballasting the vessel (1) so that the entire vessel is at first rotated less than 90° from the horizontal, next it is lowered so that a lower end (11) of the vessel rests on the seabed (16) adjacent to the jacket structure (15), and whereupon the vessel is rotated beyond 90° to bring the main section (2) into contact with the jacket structure (15) while its lower end (11) is in contact with the seabed (16); the auxiliary buoyancy sections (3) now being located on opposite sides of the jacket structure;

(d) securing the vessel (1) to the jacket structure (15) and deballasting the auxiliary sections to rotate the vessel with the jacket structure, and further de-ballasting the vessel so as to raise the vessel with the jacket structure to the water surface (17) while rotating the vessel so that the main section assumes the generally horizontal position.

2. The method according to claim 1, characterized in that in step (c), before raising the vessel with the jacket structure, the auxiliary sections (3) are de-ballasted in order to rotate the vessel (1) with the jacket structure (15) while the lower end (11) of the vessel is substantially in rolling contact with the seabed until the main section (2) of the vessel forms an angle with the sea surface (17) of 30°-70°.

3. The method according to claim 2, characterized in that the auxiliary sections (3) are de-ballasted in order to rotate the vessel (1) with the jacket structure (15) while the lower end (11) of the vessel is substantially in rolling contact with the seabed until the main section (2) of the vessel forms an angle with the sea surface (17) of about 60°.

4. The method according to claim 1, characterized by using a vessel (1) having in plan view substantially the shape of a delta with an extension (4, 5) at the apex, the extension forming the fore part of the vessel and the base (8, 9) of the delta forming the aft part, the auxiliary buoyancy sections (3) being located at the ends (8) of the base.

5. The method according to claim 1, characterized by providing the vessel (1) with permanent ballast (12) in an aft part of the vessel.

* * * * *